US011365493B2

(12) United States Patent
Zhou et al.

(10) Patent No.: US 11,365,493 B2
(45) Date of Patent: Jun. 21, 2022

(54) METHOD FOR MAKING COPOLYMER-WRAPPED NANOTUBE FIBERS

(71) Applicant: KING ABDULLAH UNIVERSITY OF SCIENCE AND TECHNOLOGY, Thuwal (SA)

(72) Inventors: Jian Zhou, Davis, CA (US); Xuezhu Xu, Davis, CA (US); Gilles Lubineau, Thuwal (SA)

(73) Assignee: KING ABDULLAH UNIVERSITY OF SCIENCE AND TECHNOLOGY, Thuwal (SA)

( * ) Notice: Subject to any disclaimer, the term of this patent is extended or adjusted under 35 U.S.C. 154(b) by 29 days.

(21) Appl. No.: 16/760,669

(22) PCT Filed: Oct. 10, 2018

(86) PCT No.: PCT/IB2018/057857

§ 371 (c)(1),
(2) Date: Apr. 30, 2020

(87) PCT Pub. No.: WO2019/086982

PCT Pub. Date: May 9, 2019

(65) Prior Publication Data

US 2021/0047753 A1 Feb. 18, 2021

Related U.S. Application Data

(60) Provisional application No. 62/621,640, filed on Jan. 25, 2018, provisional application No. 62/581,926, filed on Nov. 6, 2017.

(51) Int. Cl.
*D01D 5/34* (2006.01)
*D02J 1/04* (2006.01)
(Continued)

(52) U.S. Cl.
CPC ..... *D01D 5/06* (2013.01); *D01F 1/09* (2013.01); *D01F 8/04* (2013.01); *D02G 3/441* (2013.01); *D10B 2401/16* (2013.01)

(58) Field of Classification Search
CPC .... D01D 5/06; D01D 5/34; D01F 1/09; D01F 8/04; D02G 3/441; D02J 1/04; D10B 2401/16
(Continued)

(56) References Cited

U.S. PATENT DOCUMENTS 3,001,265 A * 9/1961 Bundy ..... D01D 5/34 264/172.15 X
3,003,223 A * 10/1961 Breen ..... D01D 5/34 264/172.15 X
(Continued)

FOREIGN PATENT DOCUMENTS

CN 101899723 A 12/2010
CN 103603086 A 2/2014
(Continued)

OTHER PUBLICATIONS

Translation of CN 107177892 A (published on Sep. 19, 2017).*
(Continued)

*Primary Examiner* — Leo B Tentoni
(74) *Attorney, Agent, or Firm* — Patent Portfolio Builders PLLC

(57) ABSTRACT

A method for making a copolymer-wrapped nanotube coaxial fiber. The method includes supplying a first dope to a spinning nozzle; supplying a second dope to the spinning nozzle; spinning the first and second dopes as a coaxial fiber into a first wet bath; and placing the coaxial fiber into a second wet bath, which is different from the first bath. The coaxial fiber has a core including parts of the first dope and a sheath including parts of the second dope. Solvent mol-
(Continued)

ecules of the second wet bath penetrate the sheath and remove an acid from the core.

14 Claims, 14 Drawing Sheets

(51) Int. Cl.

| | |
|---|---|
| ***D01D 5/06*** | (2006.01) |
| ***D01F 1/09*** | (2006.01) |
| ***D01F 8/04*** | (2006.01) |
| *D02G 3/44* | (2006.01) |

(58) Field of Classification Search
USPC ..... 264/104, 105, 172.15, 172.16, 210.2, 264/210.8, 211, 211.16
See application file for complete search history.

(56) References Cited

U.S. PATENT DOCUMENTS

| | | | | |
|---|---|---|---|---|
| 4,350,006 | A * | 9/1982 | Okamoto | D01D 5/36 264/172.15 X |
| 2003/0170166 | A1 | 9/2003 | Smalley et al. | |
| 2011/0017957 | A1 | 1/2011 | Gaillard et al. | |
| 2014/0001417 | A1 | 1/2014 | Kim et al. | |
| 2017/0370024 | A1 | 12/2017 | Zhou et al. | |
| 2019/0127887 | A1* | 5/2019 | Tascan | D01D 5/06 |

FOREIGN PATENT DOCUMENTS

| | | | |
|---|---|---|---|
| CN | 107177892 | A | 9/2017 |
| WO | 2018092091 | A1 | 5/2018 |

OTHER PUBLICATIONS

Augugliaro, F., et al., "The Flight Assembled Architecture Installation: Cooperative Construction with Flying Machines," IEEE Control Systems Magazine, Aug. 2014, vol. 34, No. 4, pp. 46-64.
Kessens, C.C., et al., "Versatile Aerial Grasping Using Self-Sealing Suction," 2016 IEEE International Conference on Robotics and Automation (ICRA), IEEE, Stockholm, May 16-21, 2016, pp. 3249-3254.
Mellinger, D., et al., "Cooperative Grasping and Transport Using Multiple Quadrotors," In: Martinoli A. et al. (eds) Distributed Autonomous Robotic Systems, Springer Tracts in Advanced Robotics, 2013, vol. 83 pp. 545-558. Springer.
Amjadi, M., et al., "Stretchable, Skin-Mountable, and Wearable Strain Sensors and Their Potential Applications: A Review," Advanced Materials, Feb. 17, 2016, vol. 26, pp. 1678-1698.
Babaie, R., et al., "Cooperative Control of Multiple Quadrotors for transporting a Common Payload," AUT Journal of Modeling and Simulation, Oct. 25, 2018, vol. 50, No. 2, pp. 147-156.
Benight, S.J., et al., "Stretchable and Self-Healing Polymers and Devices for Electronic Skin," Progress in Polymer Science, Aug. 7, 2013, vol. 38, pp. 1961-1977.
Cao, Q., et al., "Ultrathin Films of Single-Walled Carbon Nanotubes for Electronics and Sensors: A Review of Fundamental and Applied Aspects," Advanced Materials, Jan. 2, 2009, vol. 21, pp. 29-53.
Cheng, Y., et al., "A Stretchable and Highly Sensitive Graphene-Based Fiber for Sensing Tensile Strain, Bending, and Torsion," Advanced Materials, Oct. 19, 2015, vol. 27, pp. 7365-7371.
Cho, H.-H., et al., "A Chameleon-Inspired Stretchable Electronic Skin with Interactive Colour Changing Controlled by Tactile Sensing," Nature Communications, Aug. 24, 2015, vol. 6, issue No. 8011, 10 pages.
Ge, J., et al., "A Stretchable Electronic Fabric Artificial Skin with Pressure-, Lateral Strain-, and Flexion-Sensitive Properties," Advanced Materials, Nov. 30, 2015, vol. 28, pp. 722-728.
Granero, A.J., et al., "Highly Stretchable Conducting SIBS-P3HT Fibers," Advanced Functional Materials, Jan. 18, 2011, vol. 21, pp. 955-962.
International Search Report in corresponding/related International Application No. PCT/IB2018/057857, dated Dec. 20, 2018.
Kang, H.S., et al., "Light-Powered Healing of a Wearable Electrical Conductor," Advanced Functional Materials, Sep. 15, 2014, vol. 24, pp. 7273-7283.
Kou, L., et al., "Coaxial Wet-Spun Yam Supercapacitors for High-Energy Density and Safe Wearable Electronics," Nature Communications, May 2, 2014, vol. 5, Article No. 3754, 10 pages.
Lee, S., et al., "Ag Nanowire Reinforced Highly Stretchable Conductive Fibers for Wearable Electronics," Advanced Functional Materials, Apr. 20, 2015, vol. 25, pp. 3114-3121.
Li, J., "Synthesizing a Healable Stretchable Transparent Conductor," Applied Materials & Interfaces, Jun. 10, 2015, vol. 7, pp. 14140-14149.
Liao, X., et al., "A Highly Stretchable ZnO@Fiber-Based Multifunctional Nanosensor for Strain/Temperature/UV Detection," Advanced Functional Materials, Feb. 8, 2016, vol. 26, pp. 3074-3081.
Lipomi, D.J., "Stretchable Figures of Merit in Deformable Electronics," Advanced Materials, Nov. 25, 2015, vol. 28, pp. 4180-4183.
Liu, Z., et al., "Thickness-Gradient Films for High Gauge Factor Stretchable Strain Sensors," Advanced Materials, Sep. 16, 2015, vol. 27, pp. 6230-6237.
Liu, Z.F., et al., "Hierarchically Buckled Sheath-Core Fibers for Superelastic Electronics, Sensors, and Muscles," Science, Jul. 24, 2015, vol. 349, Issue 6246, pp. 400-404.
Miura, H., et al., "Foldable Textile Electronic Devices Using All-Organic Conductive Fibers," Advanced Engineering Materials, Jan. 20, 2014, vol. 16, No. 5, pp. 550-555.
Muth, J.T., et al., "Embedded 3D Printing of Strains Sensors within Highly Stretchable Elastomers," Advanced Materials, Jun. 16, 2014, vol. 26, pp. 6307-6312.
Park, J., et al., "Material Approaches to Stretchable Strain Sensors," ChemPhysChem, Apr. 27, 2015, vol. 16, No. 6, pp. 1155-1163.
Seyedin, S., et al., "Knitted Strain Sensor Textiles of Highly Conductive All-Polymeric Fibers," Applied Materials & Interfaces, Sep. 3, 2015, vol. 7, pp. 21150-21158.
Shi, W., et al., "Toward Strong Thermoplastic Elastomers with Asymmetric Miktoarm Block Copolymer Architectures," Macromolecules, May 5, 2014, Vo. 47, pp. 2037-2043.
Wang, C., et al., "Carbonized Silk Fabric for Ultrastretchable, Highly Sensitive, and Wearable Strain Sensors," Advanced Materials, May 11, 2016, vol. 28, pp. 6640-6648.
Written Opinion of the International Searching Authority in corresponding/related International Application No. PCT/IB2018/057857, dated Dec. 20, 2018.
Xin, Y., et al., "Laser-Engraved Carbon Nanotube Paper for Instilling High Sensitivity, High Stretchability, and High Linearity in Strain Sensors," Nanoscale, Aug. 3, 2017, vol. 9, pp. 10897-10905.
Zeng, W., et al., "Fiber-Based Wearable Electronics: A Review of Materials, Fabrication, Devices, and Applications," Advanced Materials, Jun. 18, 2014, vol. 26, pp. 5310-6336.
Zhou, J., et al., "Deformable and Wearable Carbon Nanotube Microwire-Based Sensors for Ultrasensitive Monitoring of Strain, Pressure and Torsion," Nanoscale, Dec. 2, 2016, vol. 9, pp. 604-612.
Zhou, J., et al., "High-Ampacity Conductive Polymer Microfibers as Fast Response Wearable Heaters and Electromechanical Actuators," Journal of Materials Chemistry C, Feb. 2016, vol. 4, pp. 1238-1249.
Zhou, J., et al., "Semi-Metallic, Strong and Stretchable Wet-Spun Conjugated Polymer Microfibers," Journal of Materials Chemistry C, Jan. 2015, vol. 3, Issue 11, pp. 2528-2538.
Zhou, J., et al., "Temperature Sensing of Micron Scale Polymer Fibers Using Fiber Bragg Gratings," Measurement Science Technology, Jul. 2, 2015, vol. 26, 8 pages.
Zhou, J., et al., "Ultrasensitive, Stretchable Strain Sensors Based on Fragmented Carbon Nanotube Papers," Applied Materials & Interfaces, Jan. 17, 2017, vol. 9, pp. 4835-4842.

(56) References Cited

OTHER PUBLICATIONS

Zhu, S., et al., "Ultrastretchable Fibers with Metallic Conductivity Using a Liquid Metal Alloy Core," Advanced Functional Materials, Dec. 13, 2012, vol. 23, pp. 2308-2314.
First Office Action in corresponding/related Chinese Application No. 201880085551.9, dated Apr. 25, 2022.

* cited by examiner

FIG. 1A
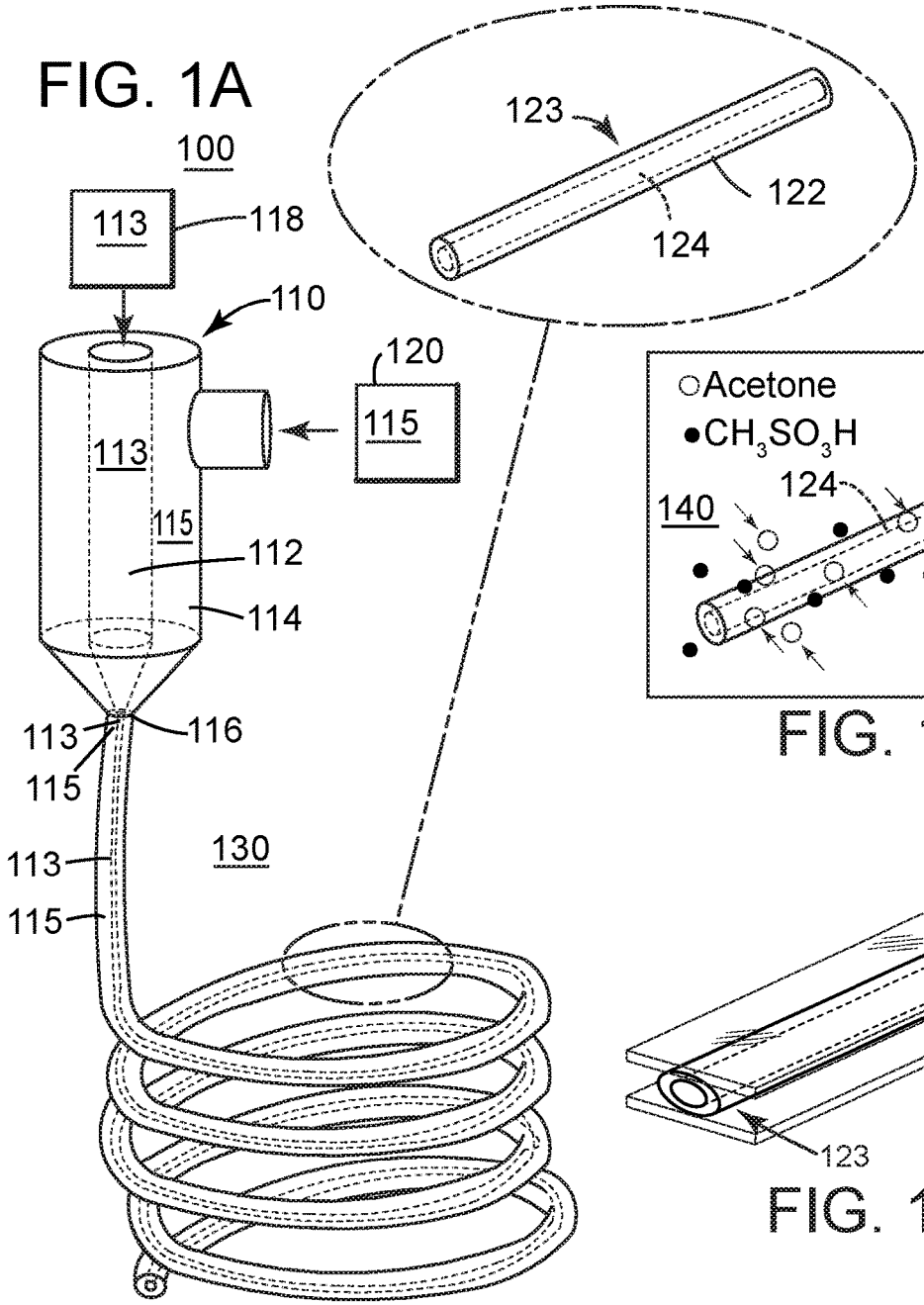
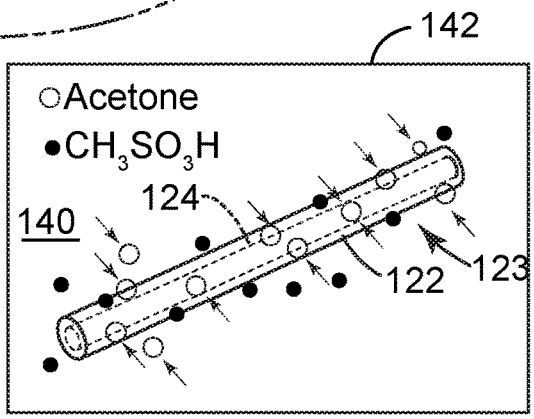
FIG. 1B
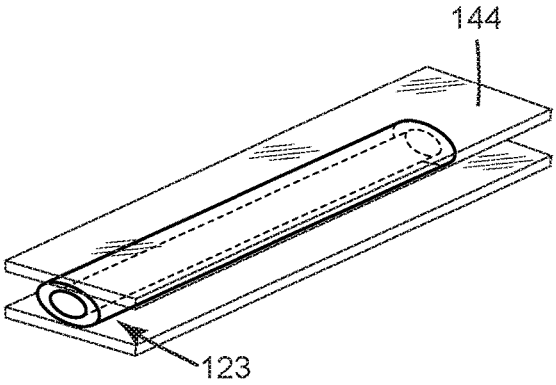
FIG. 1C
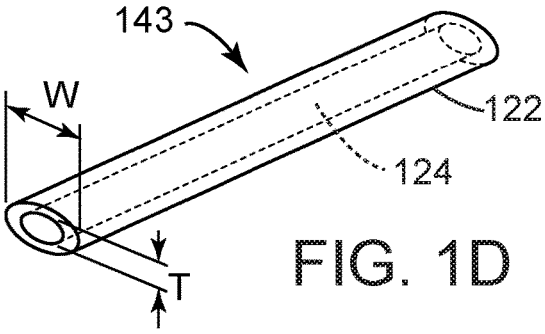
FIG. 1D

METHOD FOR MAKING COPOLYMER-WRAPPED NANOTUBE FIBERS

CROSS-REFERENCE TO RELATED APPLICATIONS

This application is a U.S. National Stage Application of International Application No. PCT/IB2018/057857, filed on Oct. 10, 2018, which claims priority to U.S. Provisional Patent Application No. 62/581,926, filed on Nov. 6, 2017, entitled "COAXIAL THERMOPLASTIC ELASTOMER-WRAPPED CARBON NANOTUBE FIBERS FOR DEFORMABLE AND WEARABLE STRAIN SENSORS," and U.S. Provisional Patent Application No. 62/621,640, filed on Jan. 25, 2018, entitled "COPOLYMER-WRAPPED NANOTUBE FIBERS AND METHOD," the disclosures of which are incorporated herein by reference in their entirety.

BACKGROUND

Technical Field

Embodiments of the subject matter disclosed herein generally relate to a method for generating copolymer-wrapped nanotube fibers, and more specifically, to methods and coaxial fibers for deformable and wearable strain sensors.

Discussion of the Background

Stretchable conductors are the main components of wearable electronics, flexible displays, transistors, mechanical sensors, and energy devices. Stretchable fiber conductors are very promising for the next generation of wearable electronics because they can be easily produced in large quantities and easily woven into fabrics. Recently, stretchable fibers have evolved towards high stretchability and high sensitivity, which are fit for applications like e-skins, and health monitoring systems.

Some of the parameters responsible for the performance of strain sensors are (1) sensitivity, (2) stretchability, and (3) linearity. The sensitivity (defined herein by the gauge factor, GF, or strain factor) is expressed by a ratio between (a) the relative change in resistance ($\Delta R/R_0$) and (b) the applied strain. The stretchability is the maximum uniaxial tensile strain of the sensor before it breaks. The linearity quantifies how constant the GF is over the measurement range. Good linearity makes the calibration process of the strain sensor easier and ensures accurate measurements throughout the whole range of applied strains.

However, strain sensors based on conventional fibers cannot combine high sensitivity (GF>100), high stretchability (strain>100%), and high linearity. For example, a carbonized silk fiber was used as a component in wearable strain sensors with a good stretchability. However, the sensitivity of the sensor was low, and the GF increased from 9.6 to 37.5 as the strain is increased from 250% to 500%, showing a large change over the strain measurement range. Graphene-based composite fibers with "compression ring" architecture increased a sensor's stretchability, but the architecture of the sensor was very complex, and its GF was low (GF=1.5 at 200% strain). An electronic fabric based on intertwined electrodes with piezoresistive rubber simultaneously (a) mapped and (b) quantified a mechanical strain, but the fabrication process was complex and time-consuming.

Therefore, there is a need for a new generation of conductive and stretchable fibers for designing high-performance strain sensors.

SUMMARY

According to an embodiment, there is a method for making a copolymer-wrapped nanotube coaxial fiber. The method includes supplying a first dope to a spinning nozzle; supplying a second dope to the spinning nozzle; spinning the first and second dopes as a coaxial fiber into a first wet bath; and placing the coaxial fiber into a second wet bath, which is different from the first bath. The coaxial fiber has a core including parts of the first dope and a sheath including parts of the second dope. The molecules of the solvent (e.g., acetone) of the second wet bath penetrate the sheath and remove an acid from the core.

According to another embodiment, there is a device for making a copolymer-wrapped nanotube coaxial fiber. The device includes a spinning nozzle having an inner channel and an outer channel; a first container holding a first dope and configured to supply the first dope to the inner channel of the spinning nozzle; a second container holding a second dope and configured to supply the second dope to the outer channel of the spinning nozzle; a third container holding a first wet bath and configured to receive a spun coaxial fiber from the spinning nozzle; and a fourth container holding a second wet bath and configured to receive the spun coaxial fiber from the third container.

According to still another embodiment, there is a method for making a copolymer-wrapped nanotube coaxial fiber. The method includes spinning first and second dopes as a coaxial fiber into a first wet bath; placing the coaxial fiber into a second wet bath to extract an acid from a core of the coaxial fiber; and flattening the coaxial fiber.

BRIEF DESCRIPTION OF THE DRAWINGS

The accompanying drawings, which are incorporated in and constitute a part of the specification, illustrate one or more embodiments and, together with the description, explain these embodiments. In the drawings:

FIG. 1A illustrates a device 100 for making a copolymer-wrapped nanostructure fiber, FIG. 1B shows a bath in which the fiber is placed after being spun, FIG. 1C illustrates the process of flattening the fiber, and FIG. 1D shows the final fiber;

DETAILED DESCRIPTION

Figure 2:
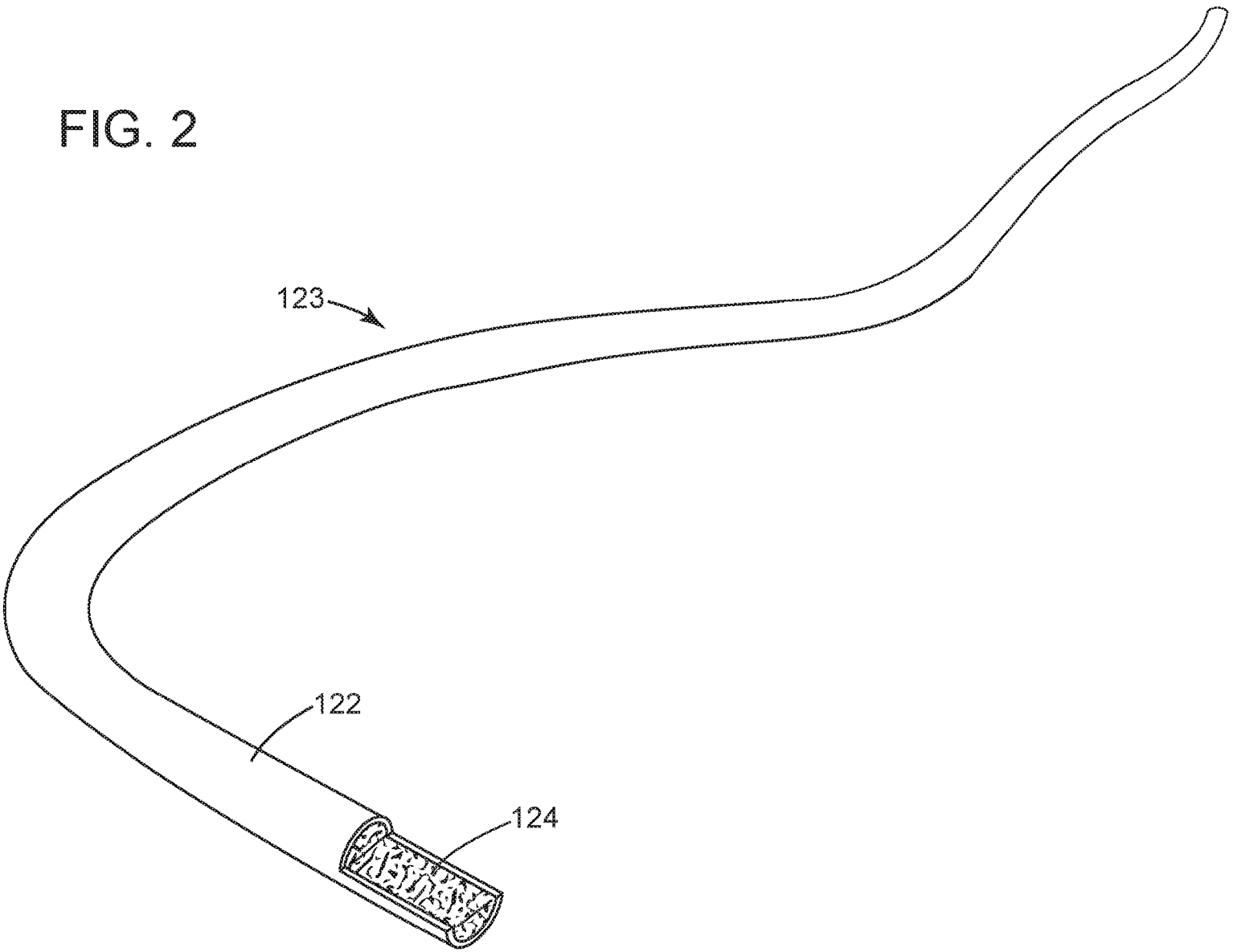
FIG. 2 illustrates the copolymer-wrapped nanostructure fiber.

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a thermoplastic elastomer (TPE)-wrapped single-walled carbon nanotube (SWCNT) microwires. However, the invention is not limited to TPE materials or carbon nanotubes. Other co-polymers that are stretchable and electrically insulators may be used instead of the TPE and other electrically conductive materials, like carbon-black, silicon, graphene, and metal nanoparticles may be used instead of carbon for the nanotubes. Those skilled in the art would understand, after reading this description, that other materials may also be used.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

One versatile approach for the industrial fabrication of continuous fibers that have been used in the past is wet-spinning. This approach provides a robust route for engineering high-performance conductive fibers. Previously, a silver nanoparticle/thermoplastic elastomer mixture was wet-spun to construct microfiber-based strain sensors, but it was challenging to maintain a continuous conductive path in the fibers and a homogeneous distribution of the metallic fillers. Conductive polymer/thermoplastic elastomer fibers were also prepared by wet-spinning for highly stretchable sensors, but it was difficult to maintain both stretchability and sensitivity, even with a high loading of the conductive polymer fillers. In previous work (see, for example, U.S. Patent Publication 2017/0370024-A1) of the authors of this disclosure, conductive poly(3,4-ethylene-dioxythiophene)/poly(styrene sulfonate) (PEDOT/PSS) polymer microfibers were fabricated via hot-drawing-assisted wet-spinning. Electrical conductivity of 2804 S cm-1 was obtained, which was accomplished by combining the vertical hot-drawing process with solvent doping and de-doping of the microfibers. Due to the brittle nature of PEDOT/PSS, the stretchability of the conductive fiber was limited to 20% and the GF was only 1.8 at 13% strain (Zhou et al., J. Mater. Chem. C. 2015, 3, 2528-2538). The wet-spinning process has also been successfully applied to make single-walled carbon nanotube (SWCNT) microwires for strain sensors with a high GF of 105 (see, for example, International Publication WO 2018/092091 A1), though the stretchability was limited to 15% (Zhou et al., Nanoscale 2017, 9, 604-612).

Most of the aforementioned sensors show a large nonlinearity. Moreover, the conductive surface of the fibers is exposed in most of these sensors, so they have the risk of short-circuiting when used as strain sensors. The consequence is poor stability and durability.

According to an embodiment, the coaxial wet-spinning approach is combined with a post-treatment process to prepare TPE-wrapped SWCNT fibers for use in high-performance strain sensors. The as-spun fibers containing SWCNT/acid dope in their core are post-treated in an acetone bath to remove acid residue, and the SWCNT core is then densified by pressing on the surface of the fibers, leading to a belt-like coaxial fiber. The fibers fragment with a high density of cracks when stretched above their crack-onset strain. The entangled networks of SWCNTs bridging the cracked fragments play a positive role during the strain sensing. As discussed next, these novel coaxial fibers are found to be suitable for high-performance strain sensors because of their capabilities as deformable and wearable electronics.

According to an embodiment illustrated in FIGS. 1A and 1B, a device 100 for making the TPE-wrapped SWCNT fibers includes a spinning nozzle 110 having an inner channel 112 and an outer channel 114. The inner channel 112 is located inside and concentric to the outer channel 114. Each of these channels receives a different dope. The two dopes do not mix inside the spinning nozzle 110. In fact, the two dopes are not in contact with each other inside the spinning nozzle 110. As shown in FIG. 1A, the dope 113 of the inner channel 112 gets in contact with the dope 115 of the outer channel 114 only at the tip 116 of the spinning nozzle 110, when the two dopes are spun out of the spinning nozzle 110.

The first dope 113 is supplied, for example, from a first storage container 118 that is in fluid communication with the inner channel 112 and the second dope 115 is supplied, for example, from a second storage container 120 that is in fluid communication with the outer channel 114.

FIG. 1A shows the first dope 113 being spun inside the second dope 115 and maintaining this configuration throughout the spinning process. This is in part due to the chemical composition of the dopes. For this embodiment, the first dope 113 is 2 wt % SWCNT/$CH_3SO_3H$. The $CH_3SO_3H$ acts as a dispersing agent for the highly concentrated SWCNTs, so that the first dope 113 could be spun into continuous microwires. The second dope 115 is a solution of TPE in $CH_2Cl_2$. This solution was selected as the outer spinning solution because TPE is an electrically insulative elastomer. This co-polymer creates an outer sheath 122 (see FIG. 2) for the spun fiber 123, which protects the fiber electrodes 124 (SWCNT core) from short-circuiting and environmental degradation. In addition, as an ultrastretchable substrate, the outer sheath 122 introduces the desired stretchability to the conductive coaxial fiber 123.

The first SWCNT/$CH_3SO_3H$ dope 113 from the inner channel 112 and the second TPE/$CH_2Cl_2$ solution 115 from the outer channel 114 are simultaneously introduced, after being spun, into an ethanol coagulation bath 130, which is hosted in a container 142. The ethanol bath 130 extracts the CH2Cl2 from the second TPE/CH2Cl2 dope, while the $CH_3SO_3H$ still remains in the SWCNT core 124.

As a result of this process, a single TPE-wrapped SWCNT coaxial fiber 123 (see both FIGS. 1A and 2) was wet-spun and collected with a length of more than 5 m, showing the potential of these fibers for large-scale production. Due to the high boiling point of $CH_3SO_3H$ (167° C.) and the quick solidification of TPE in the ethanol bath, most of the $CH_3SO_3H$ acid still remained inside the core 124, even after the fiber 123 was collected.

Then, a post-treatment process was applied as illustrated in FIG. 1B. During the post-treatment process, the $CH_3SO_3H$ acid is removed from the still fluid SWCNT core 124 by immersing the fiber 123 in an acetone bath 140, as shown in FIG. 1B. FIG. 1B shows the $CH_3SO_3H$ acid moving out of the core 124 and the acetone moving in. The extraction was monitored by observing the diameter of the fiber, and the fiber diameter decreased with a longer extraction time. The PH value of desiccated fibers also depended on the extraction time.

After taking the fiber 123 out of the acetone bath 140, which is hold in a container 142, the acetone residue has evaporated, which resulted in an uneven surface. Therefore, the fiber 123 was pressed into a belt-like shape, as illustrated in FIG. 10, for example, with a glass slide 144. In one application, the resulting thickness T and width W of the spun fiber, were 200 μm and 1050 μm, respectively. The resulting fiber 143 illustrated in FIG. 1D has now both the core 124 and the sheath 122 solid, while the fiber 123 in FIG. 1B has the core 124 liquid.

To investigate the morphology of the SWCNTs 113 in the core 124, the TPE layer 122 was dissolved in $CH_2Cl_2$. The porous structure of the SWCNT core 124 with randomly distributed SWCNT networks has been observed in SEM images. Some SWCNTs joined together and formed larger bundles, which played a positive role in reducing the overall resistance of the fiber 143. Experiments with this fiber show that the coaxial fiber 143 acted as an insulator when measured on its surface, due to the protection of the insulating TPE sheath 122. After connecting a 2 cm long SWCNT core 124 with silver paste and copper wire, the fiber was measured to have a low resistance of 142.6Ω. The experiments confirmed that the conductive coaxial fiber made of a TPE-wrapped SWCNT core was achieved through the wet-spinning and post-treatment process. The successful production of these coaxial fibers should make them desirable for adoption in wearable electronics.

Figure 3:
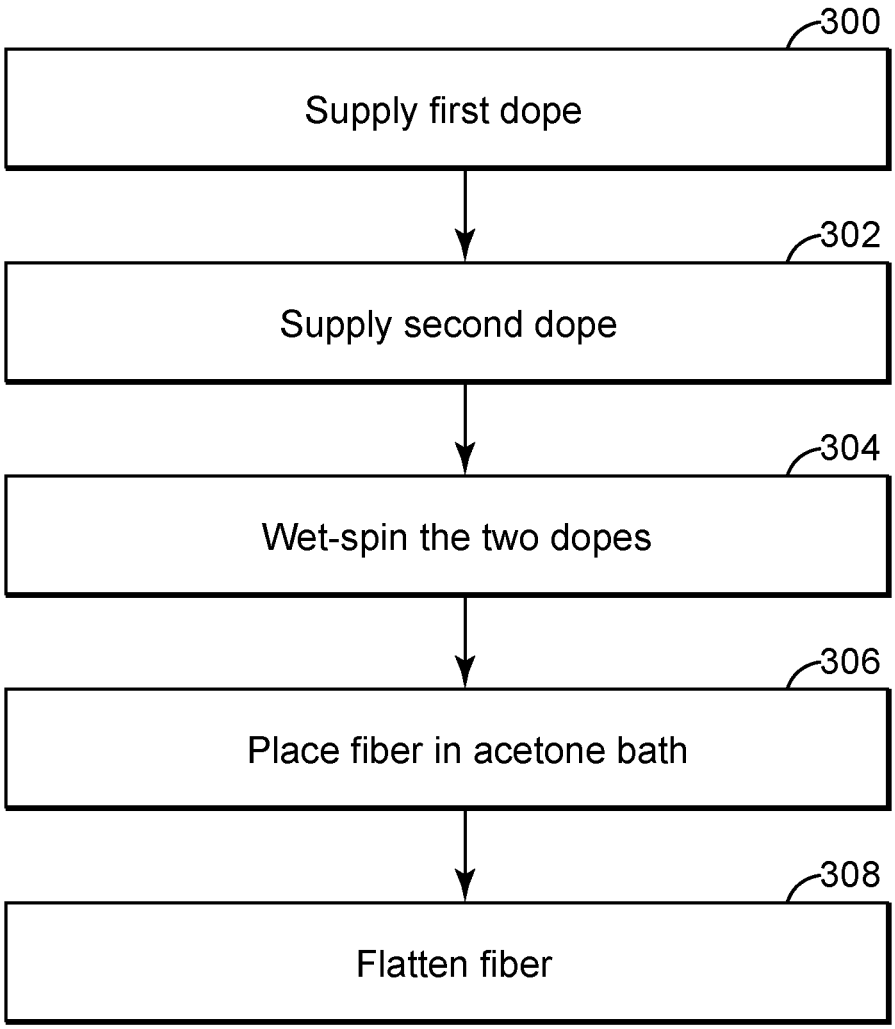
FIG. 3 is a flowchart of a method for making the copolymer-wrapped nanostructure fiber.

A method for producing the above noted coaxial fiber is now discussed with regard to FIG. 3. In step 300, a first dope 113 is supplied, from a first storage container 118, to an inner channel 112 of a spinning nozzle 110. In step 302, a second dope 115 is supplied, from a second storage container 120, to an outer channel 114 of the spinning nozzle 110. In step 304, the two dopes are wet-spun out of the spinning nozzle 110, into an ethanol bath 130. In step 306, the fiber 123 formed with the spinning nozzle 110 is placed into an acetone bath 140, to remove acid from the first dope. In optional step 308, the fiber 123 is flattened. The dopes may be the first and second dopes discussed above. Other dopes may be used as long as the external sheath is an insulator and the core includes nanostructures and is electrically conductive. Those skilled in the art would understand that other baths may be used, for example, the acetone bath may be replaced with any bath that is capable of extracting an acid from the core of the fiber. The last step of flattening the fiber is optional.

In a specific embodiment, the following materials are used to generate the fiber. The materials used for the first dope were: SWCNTs functionalized with 2.7% carboxyl groups were purchased from CheapTubes, Inc., with over 90 wt % purity and containing more than 5 wt % of MWCNT. The true density of these SWCNTs was 2.1 g $cm^{-3}$. The materials used for the second dope were: polystyrene-block-polyisoprene-block-polystyrene (TPE) (styrene, 22 wt %), methanesulfonic acid ($CH_3SO_3H$), ethanol, and dichloromethane ($CH_2Cl_2$), which were purchased from Sigma Aldrich.

Preparation of the SWCNT dope and TPE solution includes: a 2 wt % SWCNT dope was prepared by adding 0.2 g of SWCNTs into 9.8 g of $CH_3SO_3H$ and stirring for 2 min, followed by sonication using a Brason 8510 bath sonicator (250 W) (Thomas Scientific) for 60 min. The mixture was further stirred for 24 h, then passed through a 30 μm syringe filter (Pall Corporation) to remove aggregates. A 30 wt % TPE solution was prepared by mixing 9 g of TPE with 21 g of $CH_2Cl_2$ solvent at 200 rpm for 10 h.

Wet spinning of the coaxial fibers was performed as follows: the SWCNT dope was loaded into a 10 ml syringe and spun into an ethanol bath though an inner stainless steel needle (21 G). The flow rate of the ink was fixed at 150 μl/min by using a Fusion 200 syringe pump (Chemyx Inc.). The TPE solution in a 10 ml syringe was spun into the ethanol bath though an outer stainless steel needle (15 G). The flow rate of the ink was 200 μl/min. The fibers were continuously collected on a 50 mm winding spool, at a line speed of 2 to 4 m $min^{-1}$. Then, the fibers were soaked in an acetone bath for 6 h to remove the acid residue. The resulting fibers were removed from the acetone and densified by pressing with glass slides as shown in FIG. 1C. For comparison of the mechanical properties, pure TPE fibers were prepared by wet-spinning of a 20 wt % TPE/DCM solution into the ethanol bath though a stainless steel needle (21 G) at an injection rate of 200 μl/min.

The obtained fibers were characterized as follows: Scanning electron microscopy (SEM) was performed on the fibers using a Quanta 3D machine (FEI Company). The stretching and relaxing of the coaxial fibers were captured by a BX61 materials microscope (Olympus Corporation). The loading and unloading of the sample were controlled by a 5944 mechanical testing machine (Instron Corporation). Then, both ends of the 2 cm long fibers were dipped into colloidal silver ink, connected with copper wires and painted with conductive silver epoxy. The resistance change of the fibers was monitored by a 34461A digital multimeter. The incremental, cyclic stretching and relaxing program were applied to initiate the fragmentation of the SWCNT core inside the coaxial fiber. The program was set to an incremental strain of 50%, starting at 0% and continuing until 250%, at a speed of 5 mm $min^{-1}$. Then, a cyclic stretching and relaxing program with maximum strains of 100% was applied at the same speed to the fibers for five cycles. The sensitivities of the strain sensors were defined as $GF=(\Delta R/R_0)/\varepsilon$, where $R_0$ is the initial resistance, $\Delta R/R_0$ is the relative change in resistance, and c is the applied strain.

For the electrical impedance spectroscopy (EIS), the moduli of impedance, Z, was measured with an Agilent E4980A Precision LCR meter in a two-probe configuration with Kelvin clips. The frequency range was from 20 Hz to 2 MHz with a 1000 Hz step and a sweeping current of 50 mA. To understand the sensing mechanism of the fiber-based sensors, it was investigated the change in impedance across a wide range of frequencies at different applied strains (0%, 5%, 15%, 20%, 40%, 60%, and 100%).

Figures 4A, 4B:
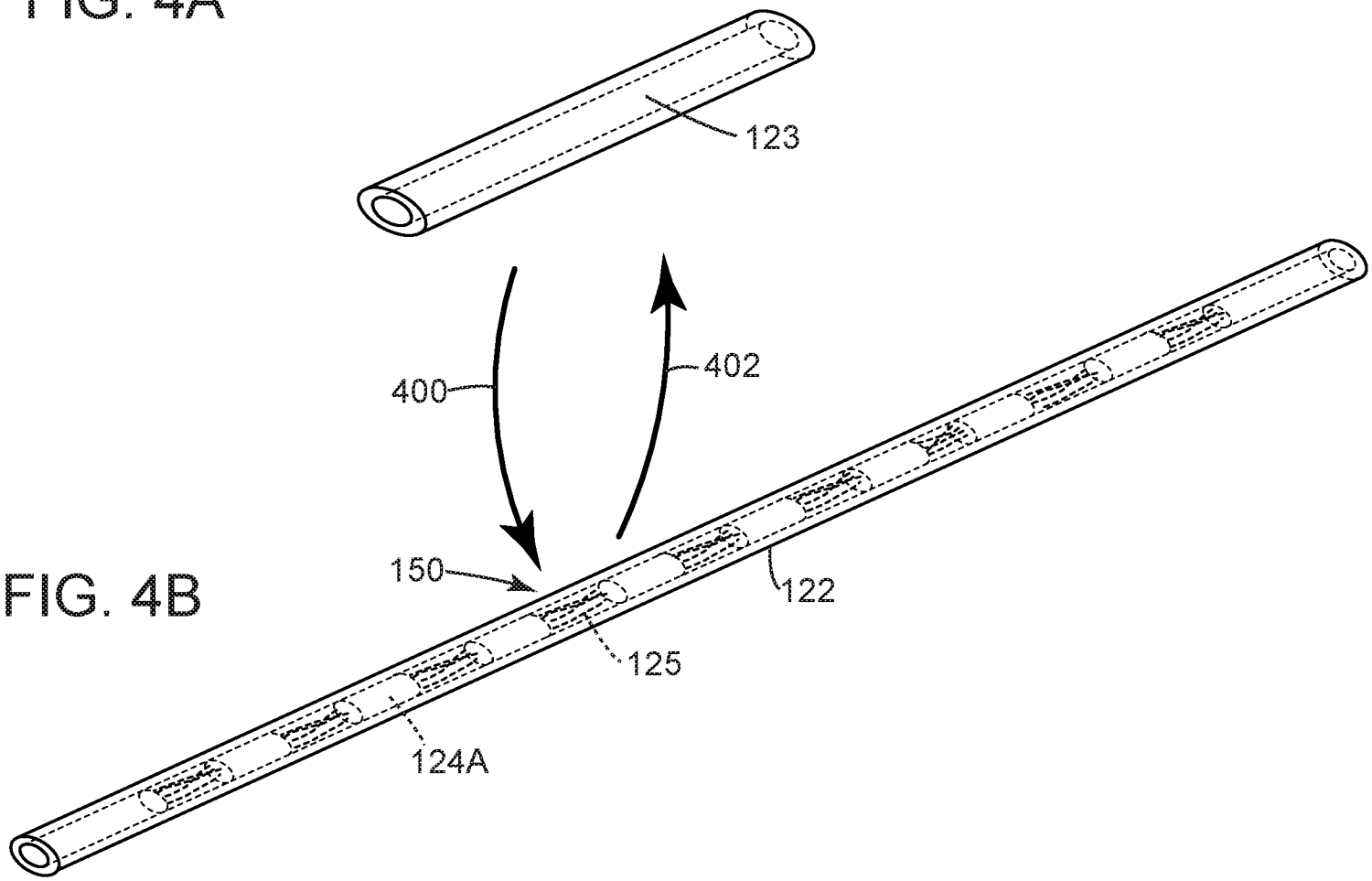
FIGS. 4A and 4B illustrate the process of stretching the fiber and the apparition of cracks.

The good linearity of the fiber 123 obtained with the method discussed above is believed to be a result of the following process. FIG. 4A shows the fiber 123 in a relaxed mode, i.e., no strain or stress is applied. When stretching is applied in step 400 to fiber 123, the length of the fiber is increased, as shown in FIG. 4B. The sheath 122, by virtue of being elastic, is capable of stretching without problems. The core 124, by virtue of having plural nanostructures (nanowalls and/or nanowires) 125 that are formed during the method discussed above, is also capable of stretching while preserving the electrical conductivity. This is so because the cracks 150 that are formed in the core 124 (which includes a high density of fragments 124A of the core 124) are filled with a network of SWCNTs 125, which are highly conductive. When the fiber is relaxed in step 402, the fiber returns to its relax mode illustrated in FIG. 4A.

Figure 5A:
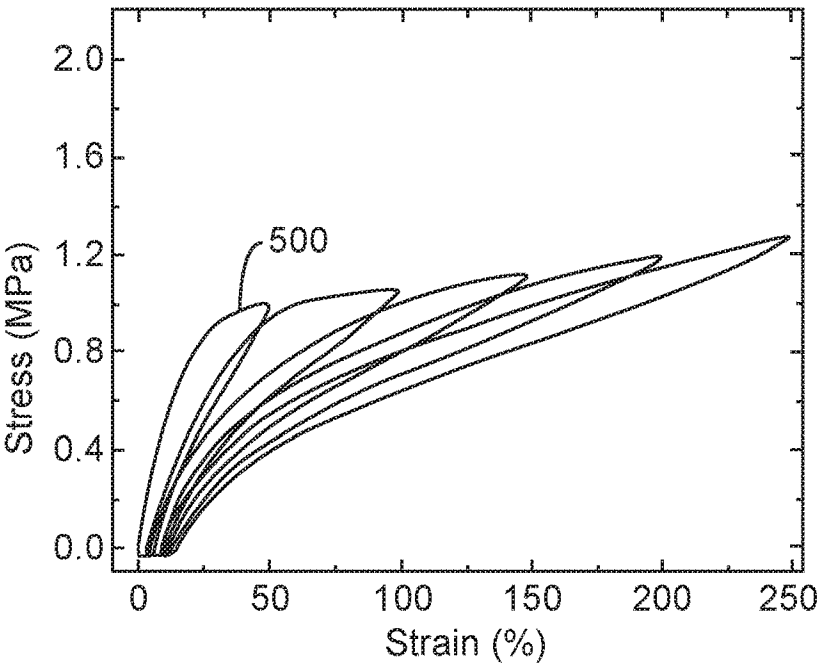
FIGS. 5A and 5B show the strain applied to a TPE fiber and the copolymer-wrapped nanostructure fiber.
Figure 5B:
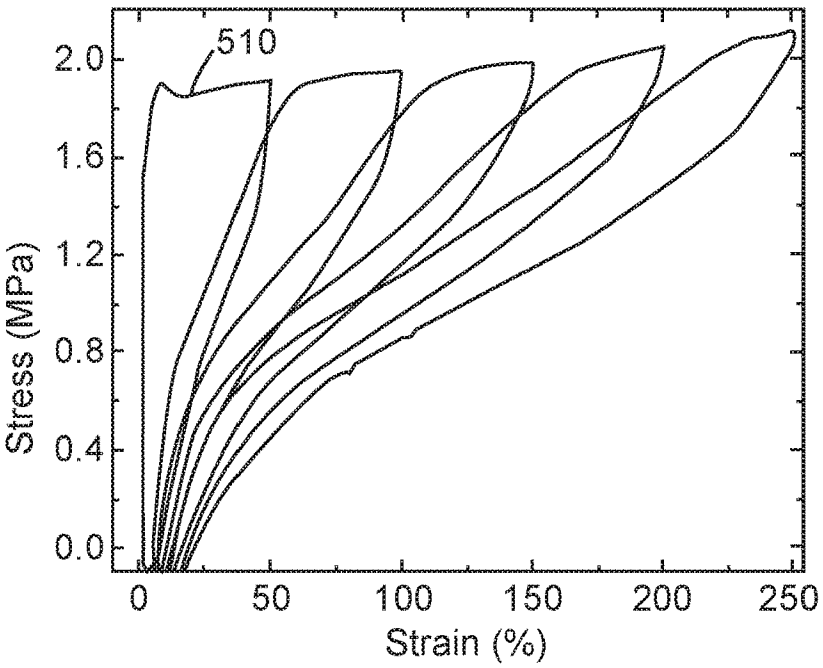

To determine the full properties of the fiber 123, various stresses were applied as now discussed with regard to FIGS. 5A and 5B. FIG. 5A shows a pure TPE fiber to which a cyclic loading and unloading is applied. The Y axis of the figure shows the stress values and the X axis of the figure show the strain values. Similarly, FIG. 5B shows the same cyclic loading and unloading for the coaxial fiber 123 manufactured as discussed above. The incremental cyclic loading and unloading was performed at a rate of 5 min $cm^{-1}$. After the first cycle (0% to 50% strain), both of the curves 500 and 510 show that there is a 10-15% residual strain, which remains during the following cycles. This indicates that there is some plastic deformation during the first cycle, but negligible deformation during the following cycles. FIG. 5A shows the typical mechanical behavior of pure TPE, which could extend far with a good elastic recovery. Compared to the pure TPE of FIG. 5A, the coaxial fibers of FIG. 5B experienced a sharp stress increase during the first loading cycle 510. The Young's modulus calculated from the first loading cycle was 112 MPa, 24 times higher than that of pure TPE fiber (4.5 MPa). These results suggest that the SWCNT core 124 increased the Young's modulus of TPE, and that the SWCNTs had conformal interfaces in the TPE matrix. Thus, the SWCNT core 124 of the coaxial fiber 123 became fragmented during loading, as indicated in FIG. 4B.

Figure 6A:
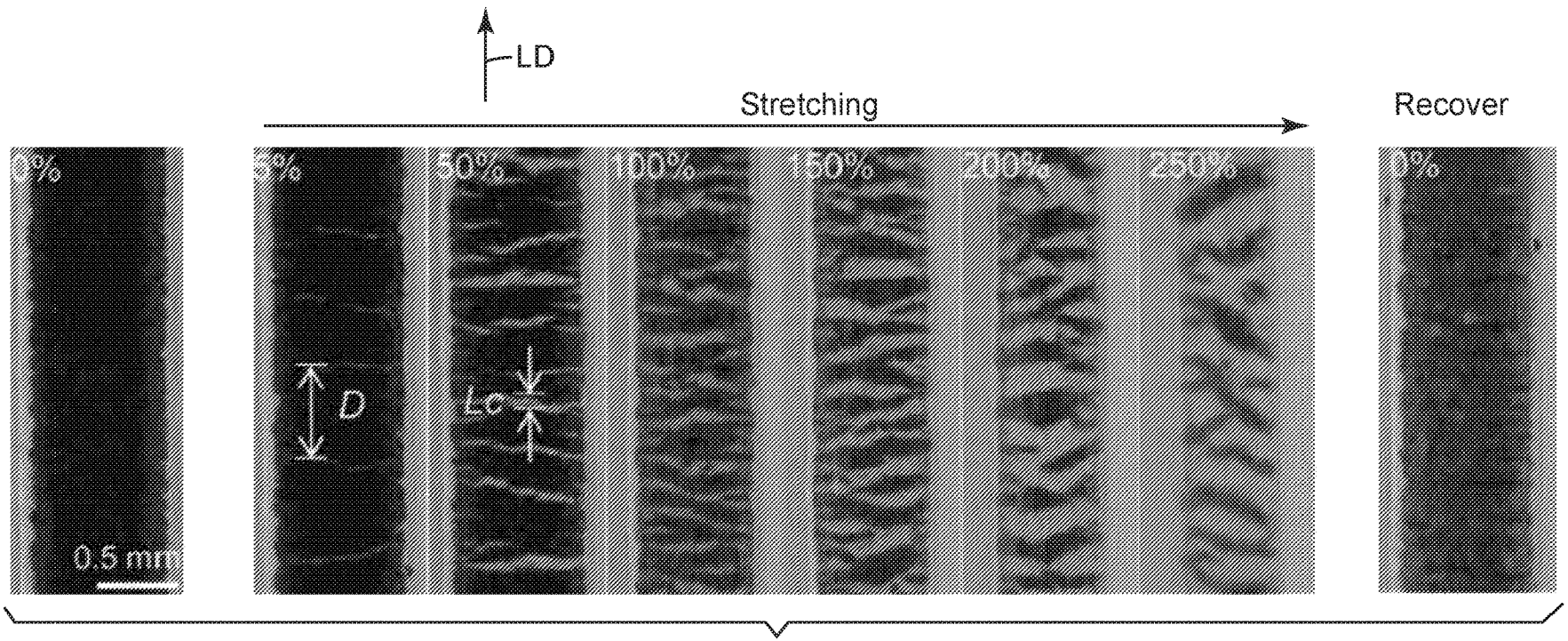
FIG. 6A shows the cracks appearing in the copolymer-wrapped nanostructure fiber.
Figure 6B:
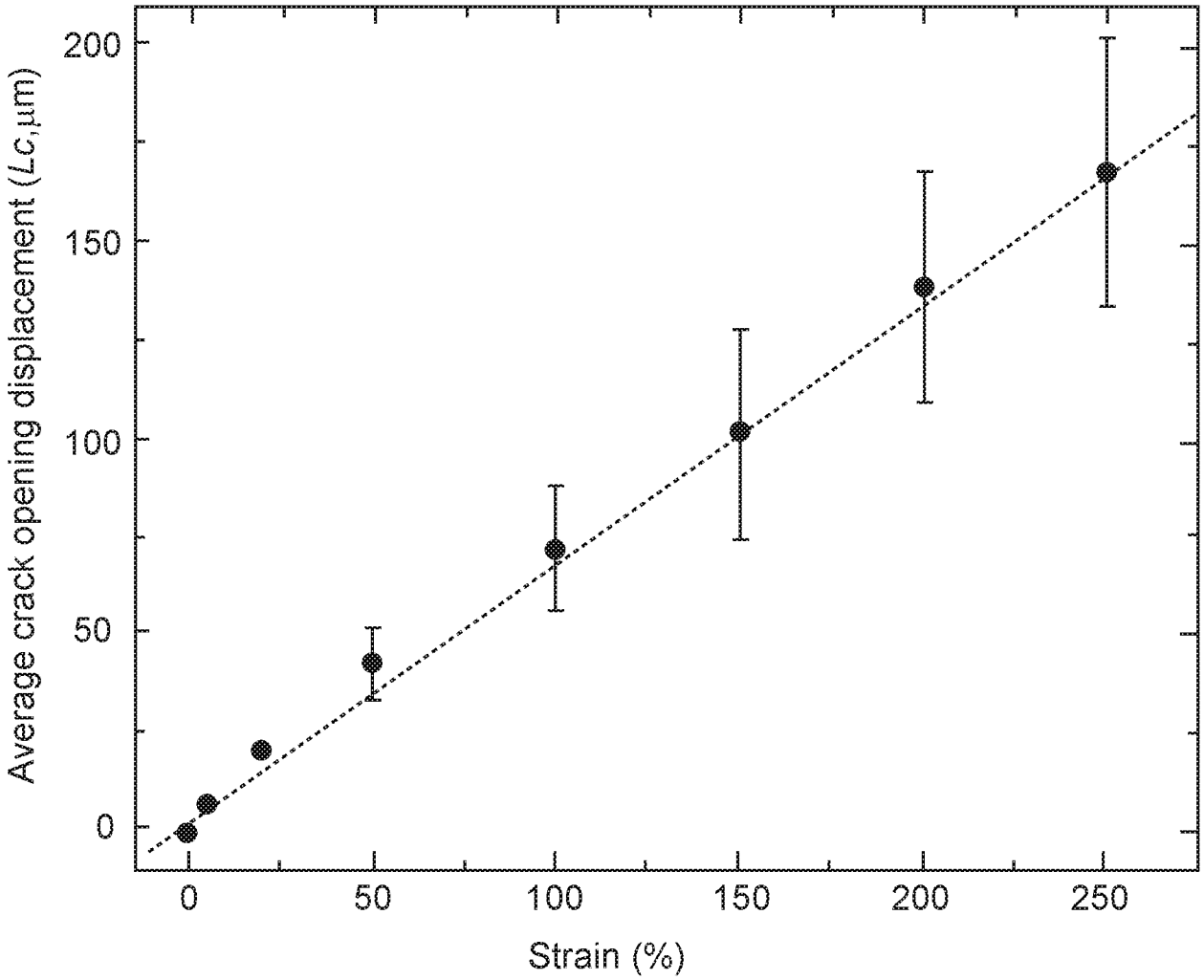
FIG. 6B shows the average crack opening with strain.

FIG. 6A depicts the development of cracks in the coaxial fiber 123 under an optical microscope. As the fiber is stretched, the crack opening displacement, $L_c$, correlates almost linearly to the applied strain (see FIG. 6B), proving the overall elastic behavior of the fiber 123. When the applied strain increased from 0% to 250%, the resistance of the fiber 123 increased from 142Ω to 2.3 MΩ. Cracks appeared perpendicular to the loading direction LD ($\varepsilon<50\%$), and then multiplied along a quasi-periodical network as the strain grew larger ($\varepsilon>50\%$). The crack density, 1/D, was found to be 17 $mm^{-1}$, much higher than found in previous studies of SWCNT wires or thin paper in PDMS substrate. Such a high crack density explains the increased stretchability and linearity of the resistance response of the fibers 123 during stretching. Compared to the initial state at 0% strain, the cracks nearly recovered completely after unloading, with small but observable openings (see right hand panel in FIG. 6). The resistance of the stretched fiber 123 was measured to be 1.5 kΩ, ten times that of the original fiber. This is ascribed to the unrecoverable conductive paths in the SWCNT core, as shown in FIG. 6A.

Figure 7A:
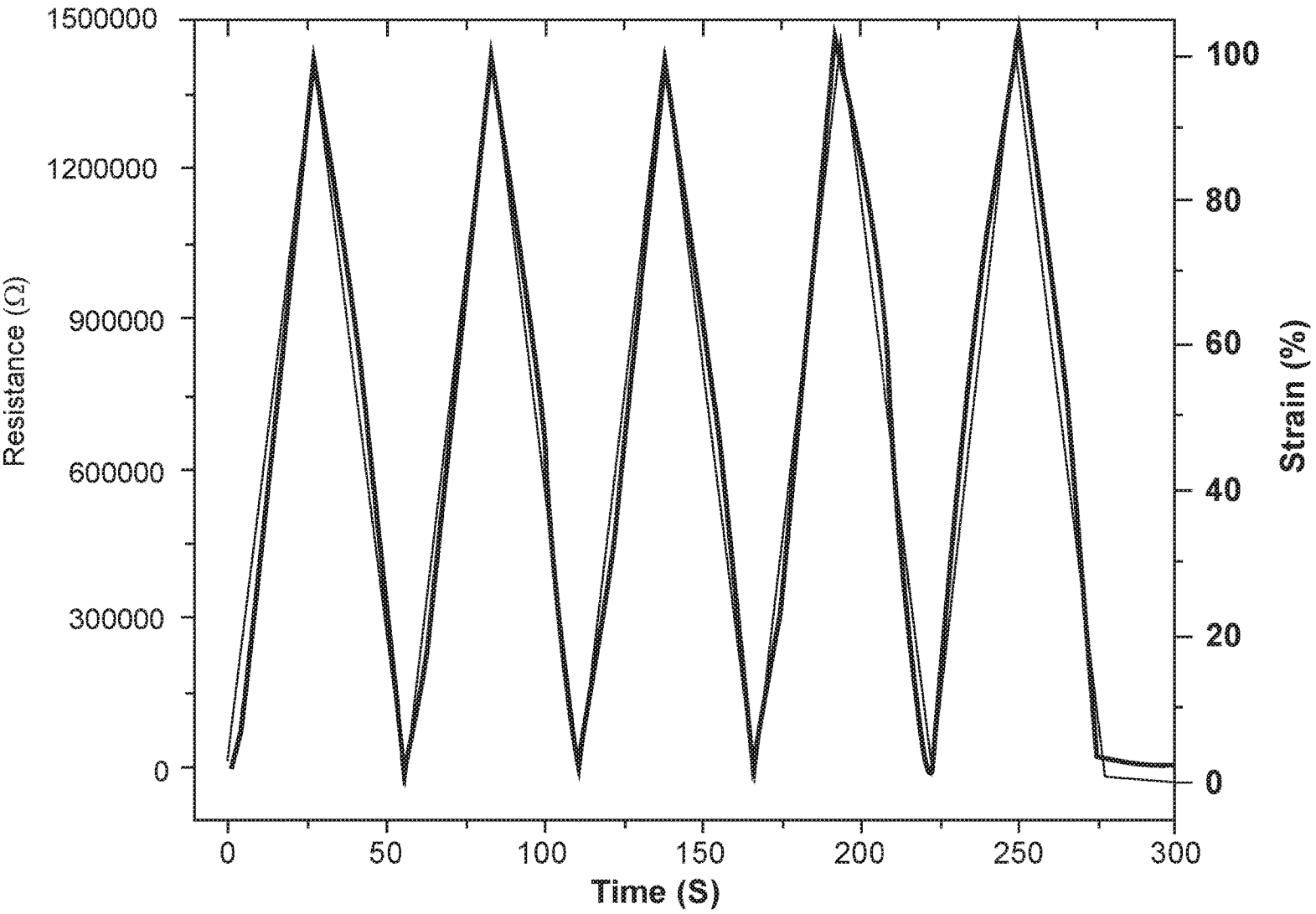
FIG. 7A shows the resistance of the copolymer-wrapped nanostructure fiber when strain is applied, FIG. 7B compares the gauge factor of the copolymer-wrapped nanostructure fiber with traditional fibers.

To use fiber 123 in a strain sensor, it needs to show high stretchability, high GF, and high sensitivity. The change in resistance of a coaxial fiber 123 with strains from 0% to 250% has been studied. The resistance increased with strain. After unloading from the 250% strain, the fragmented structure of the coaxial fiber with a high crack density of 17 $mm^{-1}$ could be used as the sensing component in strain sensors. Repetitive cyclic testing has been performed on the fibers at lower strains (0% to 100% strain), which may be more representative of strains encountered in real applications (e.g., wearable electronics). After the first cyclic test (0% to 100% strain), the subsequent cycles overlapped with minimal signs of hysteresis. FIG. 7A shows five cycles with a strain ranging from 0% to 100%, in which the $\Delta R/R_0$ progressed along a very reversible course, closely following the change in the applied strain.

To determine the sensitivity of the fiber, the relative change in resistance ($\Delta R/R_0$) with the applied strain has been determined. The change in resistance of this coaxial fiber was $\Delta R/R_0=340$ at the 100% strain. The sensing performance of the fiber-based sensor featured two linear regions with two slopes (the applied strain from 0% to 5% with a linearity of 0.99, and the applied strain from 20% to 100% with a linearity of 0.98). These values reflect the GF at different strain ranges: the GF was 48 at 0% to 5% strain and 425 at 20% to 100% strain.

Figure 7B:
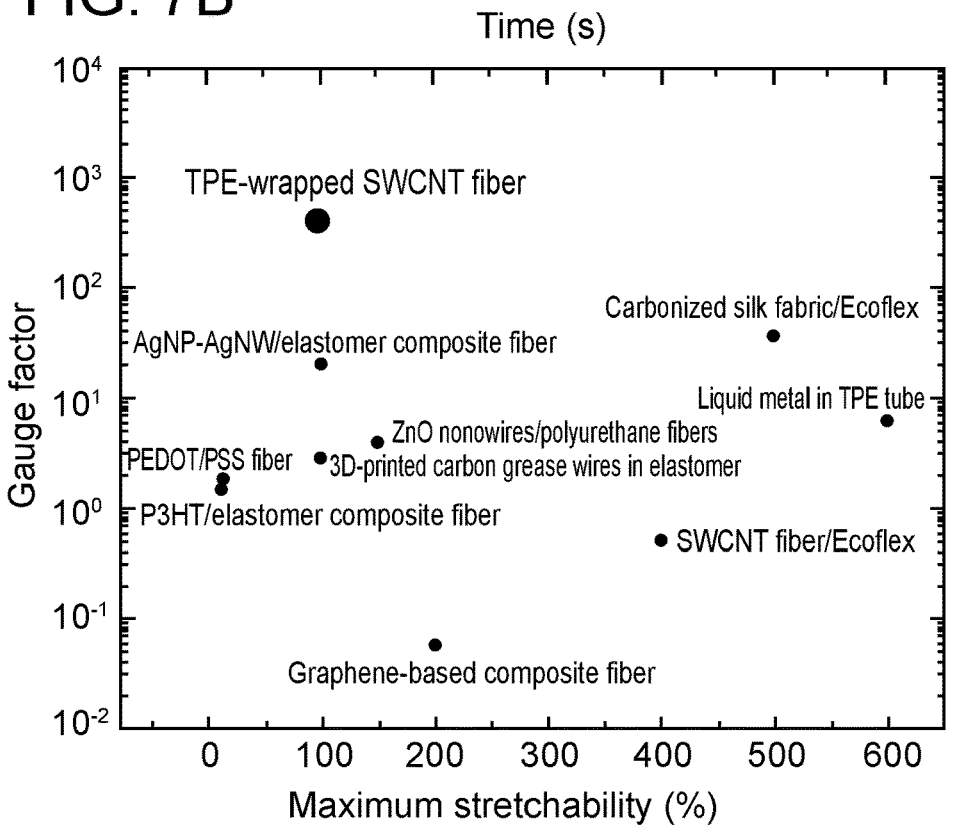
FIG. 7C shows the impedance of the copolymer-wrapped nanostructure fiber versus frequency.
FIG. 7D shows a conduction model for the copolymer-wrapped nanostructure fiber under strain.

However, conventional metal gauges have a GF of only around 2.0 at strains less than 5%. The GF was higher than conventional fiber-based strain sensors, as illustrated in FIG. 7B. Piezo-resistive strain sensors often can reach a high GF or high stretchability, but normally with hysteresis and nonlinearity. The experimental measurements indicated that a sensor using fiber 123 has good durability and reproducibility, which are important for long-term use. After 3250 cycles of stretching and relaxing from 20% to 100% strain, the performance of the strain sensor remained repeatable. The good repeatability of the sensor was confirmed at cycles 1 to 5, 1000 to 1005, and 3000 to 3005.

Figure 7C:
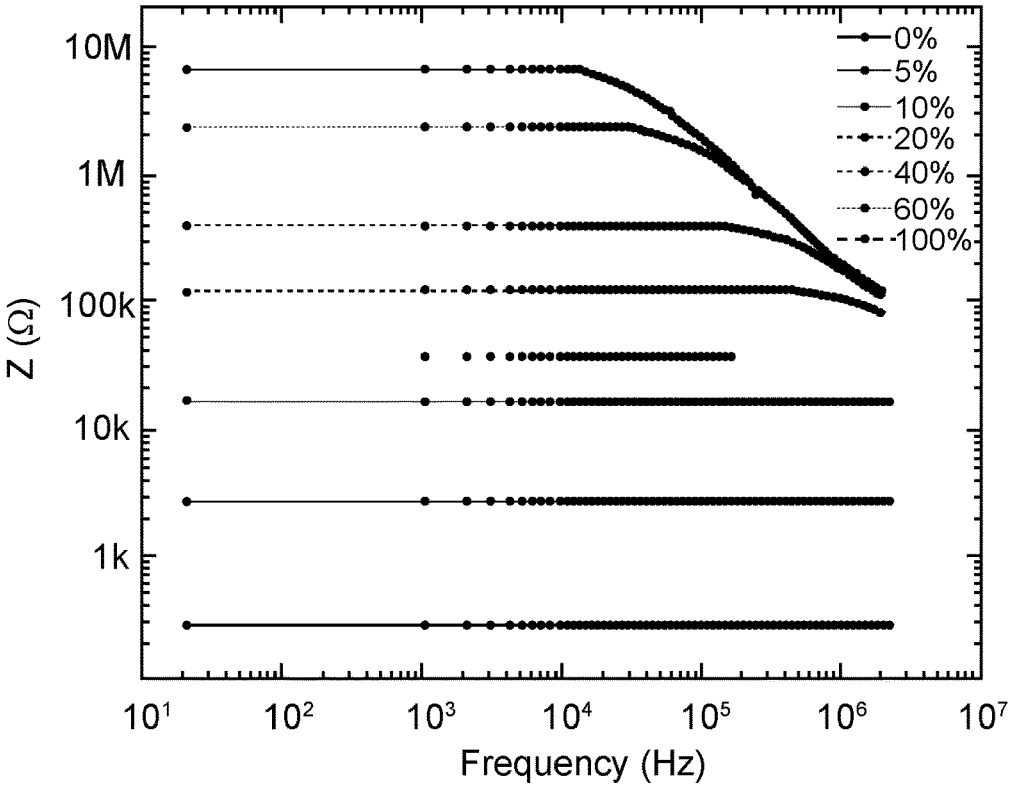

To illustrate the sensing mechanism of the strain sensor made with coaxial fibers 123, a characterization of the electrical impedance response of the fibers was performed with a wide range of frequencies. FIG. 7C displays the frequency dependencies of the moduli of the complex impedance (Z). At low strains ($\varepsilon<20\%$), the impedance was almost constant in the tested frequency range, and the conduction mechanism was expressed by the resistive behavior of the SWCNT in the core. The contacts among the SWCNTs in the crack regions ensured macroscopic ohmic behavior. At higher strains ($\varepsilon>20\%$), the impedance Z became more frequency dependent. As the strain continued to increase, the SWCNTs became increasingly disconnected. Thus, the conduction of electrons between the fragments 124A (see FIG. 4B) of the core 124 become impossible, and the SWCNT-covered interface in the TPE sheath became the only conducting path. As a result, the electron tunneling effect was the main conduction mechanism in the fiber 123, as indicated by the frequency-dependent impedance curve in FIG. 7C.

Indeed, the capacitive response at high frequencies was ascribed to this electron tunneling mechanism. These results suggest that the sensing mechanism was similar to that of SWCNT paper embedded in PDMS, where the SWCNT paper between PDMS layers and the CNT interface on PDMS play different roles at different strain levels.

Figure 7D:
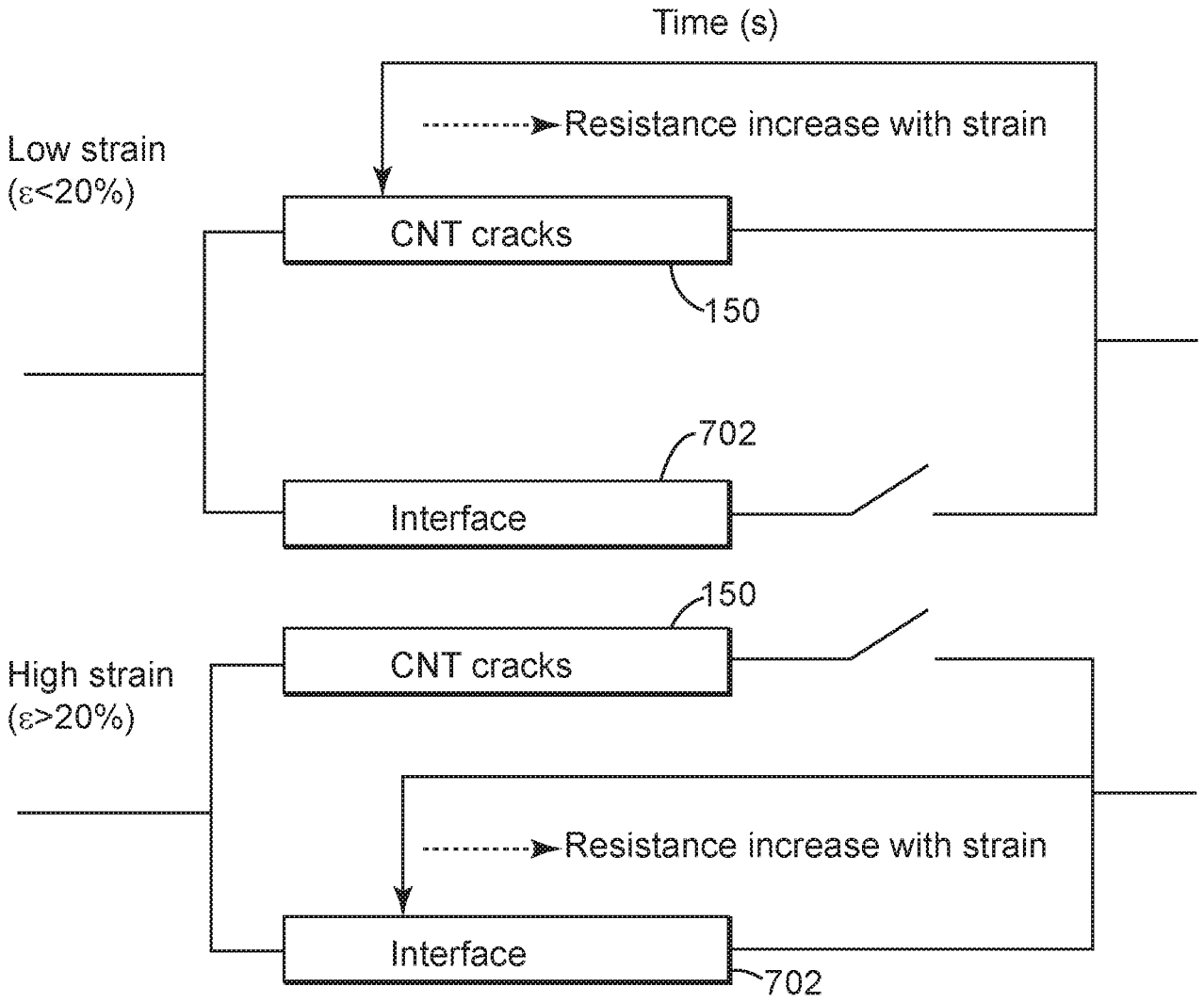

FIG. 7D shows an equivalent circuit model for fiber 123, generated from the electrical impedance spectroscopy (EIS) results, that captures the behavior of the coaxial fiber at different strain levels. At low strains ($\varepsilon<20\%$), only the SWCNT core 124 was connected to the circuit, and its resistance increased with the strain during stretching due to the opening of the cracks 150 in the fiber 123 (see FIGS. 4B and 6). The interface 702 acted as a capacitor or insulator. At high strains ($\varepsilon>20\%$), the cracks 150 grew wider until there were no SWCNT network connections between the fiber fragments 124A. At that stage, the SWCNT cracks 150 were considered open circuits. The resistance increased with the strain, which was ascribed to the SWCNT interfaces 702 attached to the TPE sheath 122. The current flowed through the capacitance due to the electron tunneling effect, which allowed greater charge movement. Ultimately, the overall capacitance of the coaxial fiber 123 was reduced.

Figure 8A:
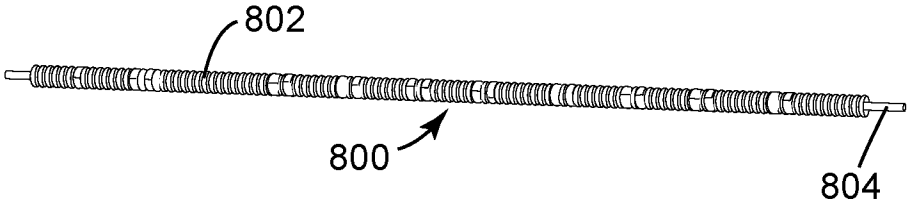
FIGS. 8A-8C show the response of plural strain sensors when located on a straight wire.
Figure 8B:
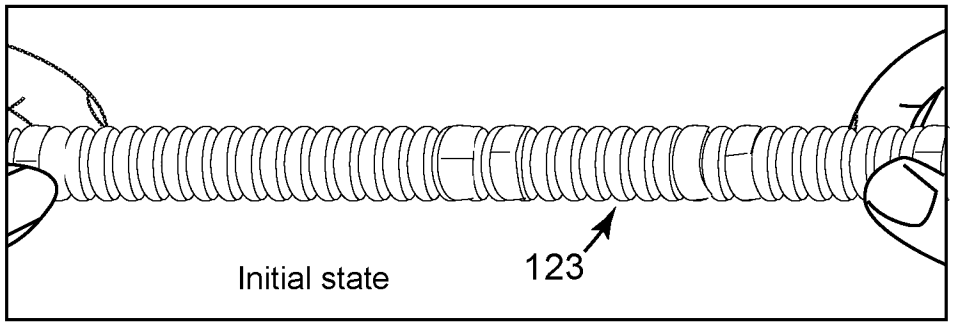
Figure 8C:
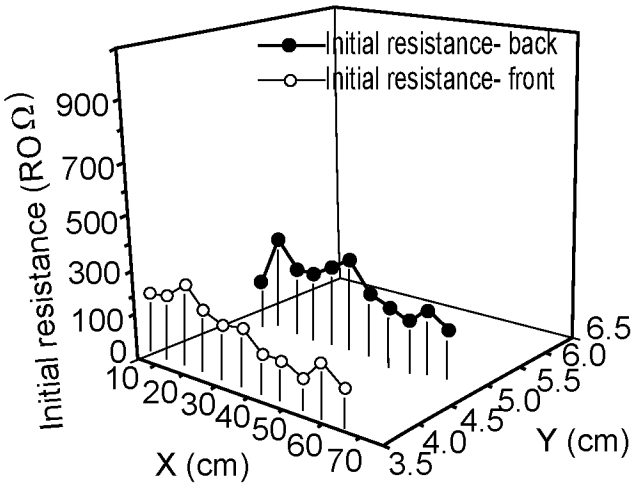
Figure 9A:
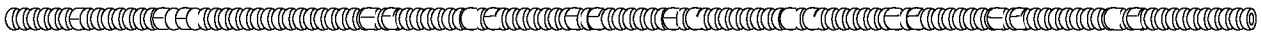
FIGS. 9A-9C show the response of the plural strain sensors when the wire is strained.
Figure 9B:
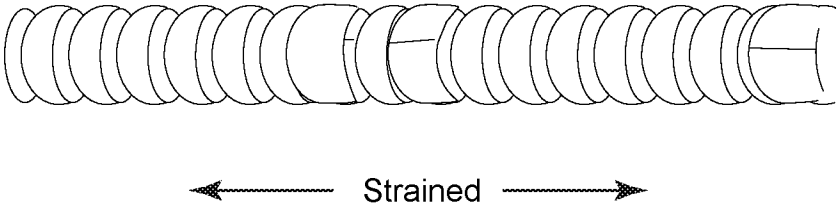
Figure 9C:
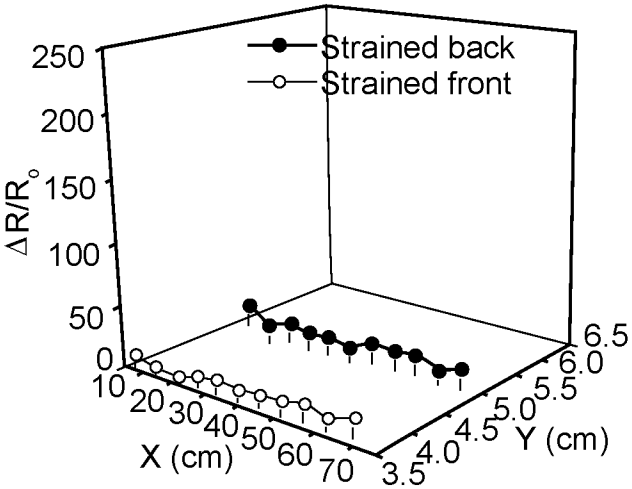

To demonstrate the performance of the coaxial fibers 123 as deformable sensors 802, eleven 4 cm long fibers 123 were attached to the back and front sides of a 70 cm long deformable, hollow cable 800 (see FIGS. 8A and 8B), which could be manipulated into "strained," "S," and "circle" shapes. The sensors 802 were attached to different locations on the cable 800 using tape, and the restriction of the cable motion was minimal. In the initial state, a metal rod 804 was inserted into the hollow cable 800 so that the strain on the coaxial fibers 123 was 0%. The initial resistance, $R_0$, was 200-300Ω for all sensors 802 (see FIG. 8C). Note that each sensor 802 has individually been connected to a measuring device for measuring a current and/or voltage. After removing the metal rod 804, the cable 800 was extended and the coaxial fibers 123 were in a "strained" state, as shown in FIGS. 9A and 9B. The resistance of the fibers 123 increased, corresponding to a strain of 10% (see FIG. 9C). The sensors 802 on the back and front sides of the cable 800 had similar $\Delta R/R_0$ in the uniaxial "strained" state, indicating that all sensors 802 experienced the same level of strain.

Figure 10B:
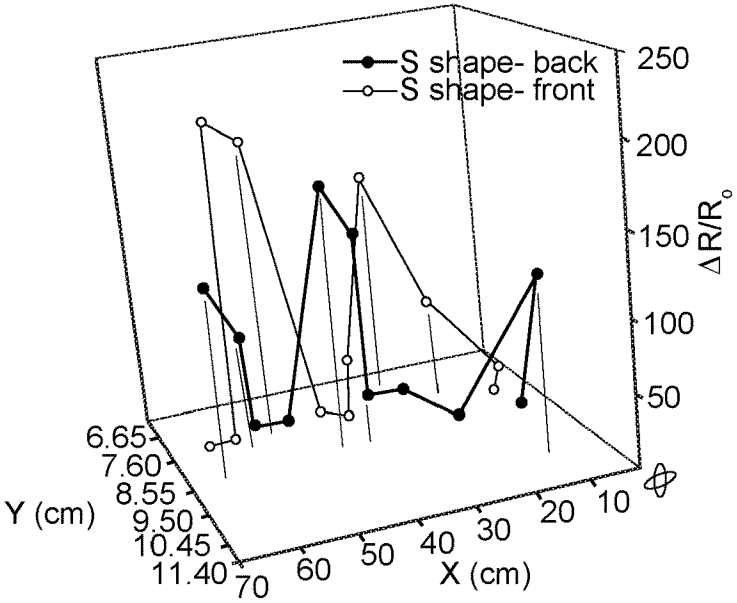
FIGS. 10A-10B show the response of the plural strain sensors when the wire is bent in an S-shape.
Figure 10A:
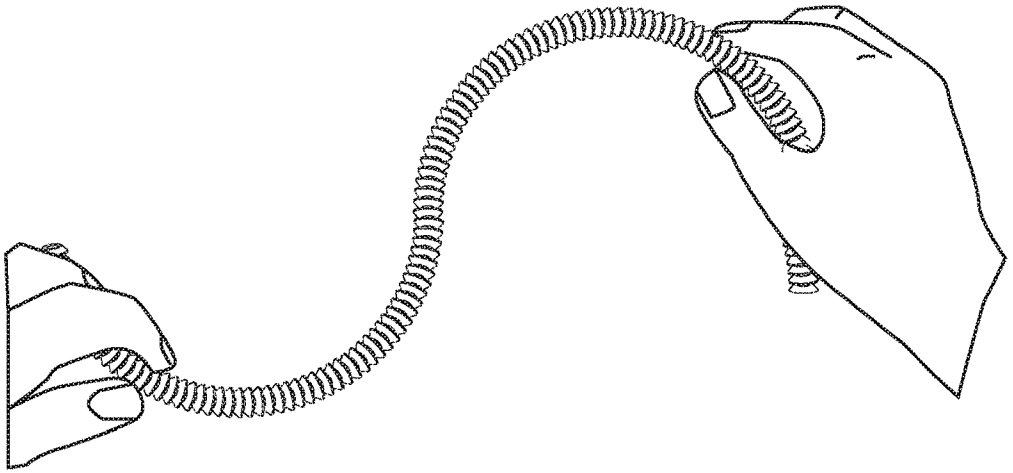
Figure 10D:
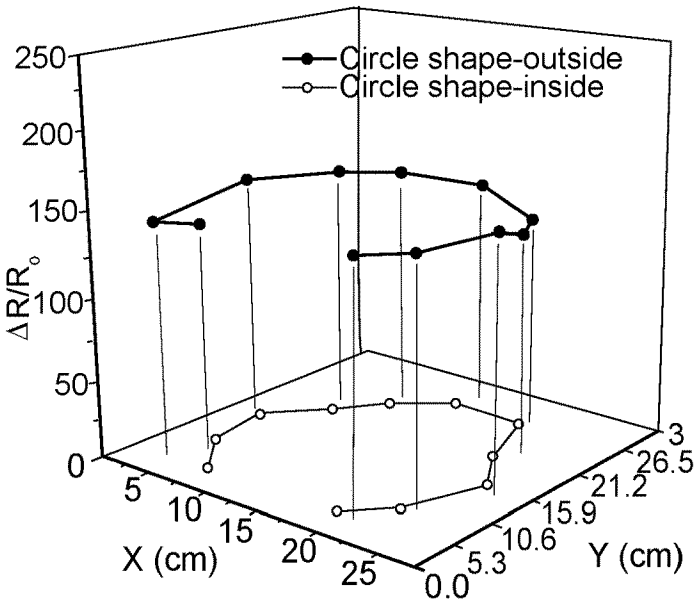
FIGS. 10C-10D show the response of the plural strain sensors when the wire is bent in a circular shape.
Figure 10C:
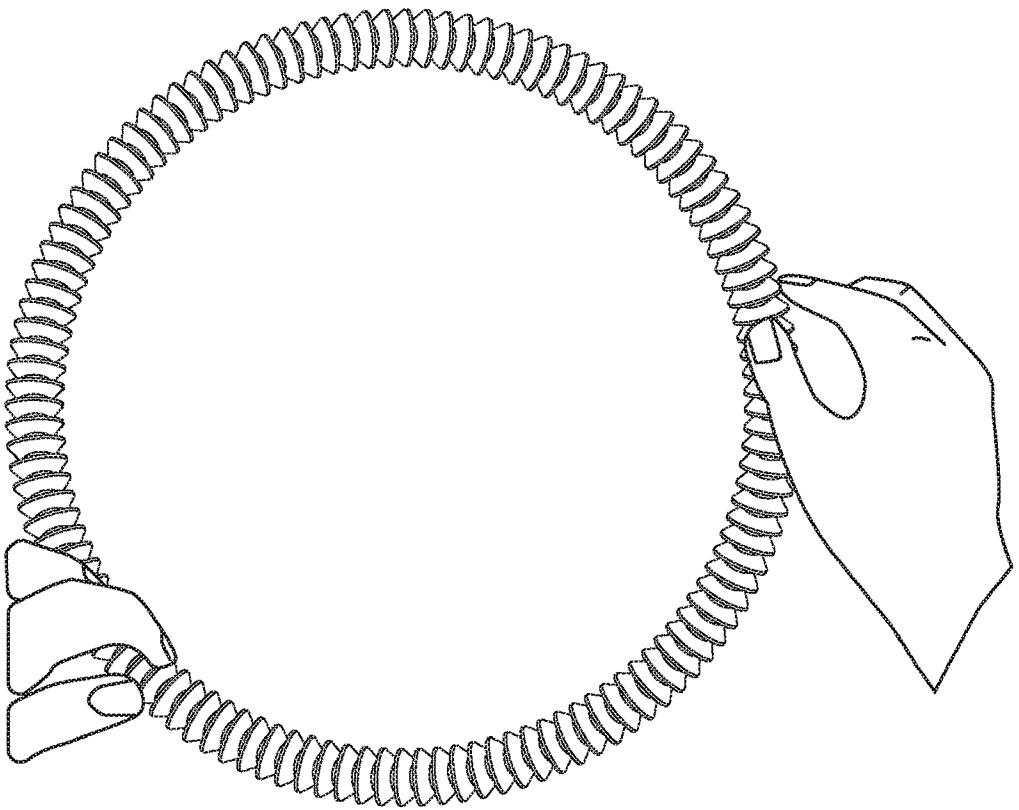

By manipulating the cable 800 into "S" (see FIG. 10A) and "circle" (see FIG. 10C) shapes, the fibers 123 on the two sides underwent asymmetrical deformation, leading to a dramatic difference between the $\Delta R/R_0$ of the curved inner and outer surfaces, as shown in FIGS. 10B and 10D. Based on these measurements, it is possible to distinguish the shape (or state) of the cable 800 through the 3D curves of the $\Delta R/R_0$ coordinates, proving that the coaxial fibers 123 can be used as sensors 802 for detecting and tracking the complicated movements of deformable objects. The same fibers may be attached to another type of objects, for example, a balloon, a moving component of a machine, or the hand of a patient or any region of a human body and changes in the resistance of the sensors may be measured. A library of such measurements may be generated, and a computer may recognize, based on a comparison of the measured patterns and the patterns stored in the library, the shape or movement of the object to which the sensors are attached.

The potential for the coaxial fibers 123 in wearable electronics for sensor/human interface interactions has been demonstrated as illustrated in FIGS. 8A to 10D. Thus, a coaxial wet-spinning and post-treatment approach for making coaxial fibers of thermoplastic elastomer-wrapped SWCNTs for high-performance strain sensors is achievable and desirable. The method discussed with regard to FIG. 3 is industrially feasible and applicable to conductive nanomaterials that cannot be wet-spun using previous methods. The coaxial fibers are highly stretchable and highly conductive. Owing to the coating of electrically insulative and highly stretchable thermoplastic elastomer, the coaxial fibers are robust enough to be used as stretchable interconnects and as deformable and wearable strain sensors. A strain sensor based on the coaxial conductive fiber displayed several merits: (1) it combined high sensitivity, high stretchability, and high linearity; (2) the TPE sheath prevented short circuiting and ensured safe operation of the device; (3) the fibers demonstrated potential for large-scale production; and (4) the process for integration into wearable textiles was easy.

The coaxial fibers discussed above can find a wide range of applications in deformable and wearable electronic devices. The examples discussed above can be extended to other electrically conductive materials, e.g., carbon nanomaterials, metal nanoparticles, and conductive polymers, offering another approach to the next generation of deformable and wearable devices.

The disclosed embodiments provide methods and mechanisms for generating a fiber suitable for a strain sensor. It should be understood that this description is not intended to limit the invention. On the contrary, the embodiments are intended to cover alternatives, modifications and equivalents, which are included in the spirit and scope of the invention as defined by the appended claims. Further, in the detailed description of the embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

REFERENCES

Kessens, C. C., Thomas, J., Desai, J. P., and Kumar, V. (2016). Versatile Aerial Grasping Using Self-Sealing Suction. In *IEEE International Conference on Robotics and Automation*. IEEE, Stockholm.

Augugliaro, F., Lupashin, S., Hamer, M., Male, C., Hehn, M., Mueller, M. W., Willmann, J. S., Gramazio, F., Kohler, M., and D'Andrea, R. (2014). The flight assembled architecture installation: Cooperative construction with flying machines. *IEEE Control Systems,* 34(4), 46-64.

Mellinger, D., Shomin, M., Michael, N., and Kumar, V. (2013). Cooperative grasping and transport using multiple quadrotors. In *Distributed autonomous robotic systems,* 545-558. Springer.

What is claimed is:

1. A method for making a copolymer-wrapped nanotube coaxial fiber, the method comprising:

supplying a first dope to a spinning nozzle;

supplying a second dope to the spinning nozzle;

spinning the first and second dopes as a coaxial fiber into a first wet bath; and placing the coaxial fiber into a second wet bath, which is different from the first bath, wherein the coaxial fiber has a core including parts of the first dope and a sheath including parts of the second dope, and wherein molecules of the second wet bath penetrate the sheath and remove an acid from the core.

2. The method of claim 1, wherein the core is fluid before the second wetbath and becomes solid after the second wet bath.

3. The method of claim 1, wherein the first dope includes single-walled carbon nanotubes (SWCNTs).

4. The method of claim 3, wherein the first dope further includes a dispersing agent.

5. The method of claim 4, wherein the dispersing agent is $CH_3SO_3H$.

6. The method of claim 5, wherein the second bath is an acetone bath that extracts the $CH_3SO_3H$ from the core.

7. The method of claim 3, wherein the first dope includes 2% SWCNT and $CH_3SO_3H$.

8. The method of claim 3, wherein the second dope includes a thermoplastic elastomer.

9. The method of claim 8, wherein the second dope further includes $CH_2Cl_2$.

10. The method of claim 9, wherein the first bath is an ethanol coagulation bath.

11. The method of claim 10, wherein the ethanol bath extracts the $CH_2Cl_2$ from the sheath.

12. The method of claim 1, wherein the core is electrically conductive and the sheath is an insulator.

13. The method of claim 1, further comprising:

flattening the coaxial fiber.

14. A method for making a copolymer-wrapped nanotube coaxial fiber, the method comprising:

spinning first and second dopes as a coaxial fiber into a first wet bath;

placing the coaxial fiber into a second wet bath to extract an acid from a core of the coaxial fiber; and flattening the coaxial fiber.

* * * * *